US006380910B1

(12) United States Patent
Moustakas et al.

(10) Patent No.: US 6,380,910 B1
(45) Date of Patent: Apr. 30, 2002

(54) WIRELESS COMMUNICATIONS DEVICE HAVING A COMPACT ANTENNA CLUSTER

(75) Inventors: Aris L Moustakas, New York, NY (US); Hugo F Safar, Wesfield, NJ (US); Steven H Simon, Hoboken, NJ (US); Marin Stoytchev, Westfield, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/757,993

(22) Filed: Jan. 10, 2001

(51) Int. Cl.[7] ..... H01Q 21/00
(52) U.S. Cl. ..... 343/893; 343/702
(58) Field of Search ..... 343/702, 893, 343/725, 729, 844, 853

(56) References Cited

U.S. PATENT DOCUMENTS 5,771,022 A 6/1998 Vaughn et al. ..... 343/702

OTHER PUBLICATIONS

Closely Spaced Monopoles For Mobile Communications, by Vaughan, R. G. et al., American Geophysical Union, Paper No. 93RS010079 (1993).

*Primary Examiner*—Don Wong
*Assistant Examiner*—Hoang Nguyen
(74) *Attorney, Agent, or Firm*—Claude R. Narcisse

(57) ABSTRACT

A wireless communication device comprising a signal processing device coupled to a cluster of multiple port antennas that can simultaneously transmit and/or receive communication signals. The cluster of antennas operates within a frequency band having maximum frequency f, and at least a pair of the antenna ports is placed in a volume of space whose longest linear dimension is $\lambda/3$ or less where $\lambda$ is equal to c/f. During operation of the antenna cluster, the radiation patterns from different antennas have main lobes that point in different directions and have correlations of 0.7 or less with respect to each other.

30 Claims, 7 Drawing Sheets

WIRELESS COMMUNICATIONS DEVICE HAVING A COMPACT ANTENNA CLUSTER

BACKGROUND OF THE INVENTION

1. Field of the Invention

The present invention generally relates to wireless devices comprising a cluster of antennas coupled to a signal processing device and a method of constructing such devices.

2. Description of the Related Art

One of the more critical pieces of equipment in a communication network and, in particular, in a wireless communication network is the antenna. Antennas are used to convey information (i.e., transmit and receive information) in the form of electromagnetic waves over communication links of a network.

The owners and/or operators of communication networks, i.e., the service providers, are constantly searching for methods and equipment that can meet the changing needs of their subscribers. Subscribers of communication networks, including wireless communication networks, require higher information throughput in order to exploit the expanding range of services being provided by current communication networks. For example, wireless communication subscribers are now able to have simultaneous access to data networks such as the Internet and to telephony networks such as the Public Switched Telephone Network (PSTN). Also, service providers are constantly investigating new techniques that would allow them to increase their information transfer rate. Information transfer rate is the amount of information—usually measured in bits per second—successfully conveyed over a communication channel. The information transfer rate can be increased in a number of well known manners. One way is by increasing the power of the transmitted signals. A second way is by expanding the frequency range (i.e., bandwidth) over which the communication is established. However, both power and bandwidth are limited by certain entities such as governmental and standards organizations that regulate such factors. In addition, for portable devices, power is limited by battery life.

An approach that circumvents the power and bandwidth limitations is to increase the number of antennas used to transmit and receive communication signals. Typically, the antennas are arranged as an array of antennas. Three of the more general ways of using antenna arrays are (a) phased array applications, (b) spatial diversity techniques (c) space-time transmit diversity techniques as well as (d) more general Multiple Input Multiple Output (MIMO) techniques. A phased array comprises an antenna array coupled to a device, which controls the relative phase of the signal in each antenna in order to form a focused beam in a particular direction in space. Spatial diversity is the selection of a particular antenna or a group of antennas from an array of antennas so as to transmit or receive signals in order to improve information throughput. In a spatially diverse structure the antenna array is typically coupled to a receive diversity device that utilizes one of many combining techniques, such as Maximum Ratio Combining, switching, or other combining techniques well known to those skilled in the art. Unlike phased arrays and spatial diversity techniques wherein one or a group of antennas are used to transmit or receive a single signal, space-time transmit diversity and MIMO techniques use an antenna array coupled to a signal processing device to simultaneously transmit and/or receive multiple distinct signals. Space-time transmit diversity coding (STTD) uses two or more transmitting antennas in order to take advantage of both the spatial and temporal diversity of the channel; WCDMA for UMTS, p. 97, ed., H. Holma & A. Toskala.

One of the main features of MIMO systems is that they benefit from the multipath propagation of radio signals. In a multipath environment, radio waves transmitted by an antenna do not propagate in straight lines towards the receive antenna. Rather, the radio waves scatter off a multitude of objects that block the direct path of propagation. Thus, the environment creates a multitude of possible paths from transmit to receive antennas. These multiple paths interfere with each other at the location of the receive antenna. This interference process creates a pattern of maxima and minima of received power, with the typical spatial separation between consecutive maxima being approximately one wavelength. MIMO systems exploit the rich scattering environment, and use multiple transmitters and receivers to create, in effect, a plurality of parallel subchannels each of which carries independent information. For transmitting antennas, the transmitted signals occupy the same bandwidth simultaneously and thus spectral efficiency is roughly proportional to the number of subchannels. For receiving antennas, MIMO systems use a combination of linear and nonlinear detection techniques to disentangle the mutually interfering signals. Theoretically, the richer the scattering, the more subchannels that can be supported.

While MIMO techniques theoretically allow antenna arrays to have relatively high information rates, the actual achieved information transfer rate will greatly depend on how the information is coded in the different subchannels. An example of how a MIMO system can be implemented is the BLAST (Bell Labs LAyered Space Time) scheme conceived by Lucent Technologics headquartered in Murray Hill, N.J. There are several realizations of the general BLAST architecture. One of them is known as diagonal-BLAST, or D-BLAST, proposed by G. J. Foschini and M. Gans, *Wireless Commun.* 6, 311 (1998). Another alternative includes vertical-BLAST, or V-BLAST (proposed by G. D. Golden, G. J. Foschini, R. A. Valenzuela, and P. W. Wolniansky, *Electronic Letters* 35, 14 (1999)). These implementations can reach a significant (above 80%) fraction of the theoretical information transfer rate expected for rich scattering environments.

As with the idealized MIMO case, in all BLAST implementations the information transfer rate of the system increases as the number of antennas in a transmit and/or receive array is increased. However, in many cases the amount of space available for the antenna array is limited. In particular, the space limitation is very critical for portable wireless devices (e.g., cell phones, Personal Digital Assistants (PDA)). Increasing the number of antennas in an array of limited space decreases the spacing between individual antennas in the array. The reduced spacing between antennas typically causes signal correlation to occur between signals received from different antennas. Signal correlation reduces the gain in information transfer rate obtained by the use of MIMO techniques; A. L. Moustakas et al., *Science* 287, 287 (2000).

Correlation is quantitatively defined in terms of at least two signals. When any two signals $s_1(t)$ and $s_2(t)$ are being transmitted or received, the degree of correlation between these two signals is given by the absolute value of the following expression:

$$\frac{\int_{t_1}^{t_2} s_1(t)s_2(t)^* \, dt}{\sqrt{\int_{t_1}^{t_2} |s_1(t)|^2 \, dt \int_{t_1}^{t_2} |s_2(t)|^2 \, dt}}$$

where $s_2^*(t)$ corresponds to the complex conjugate of $s_2(t)$ and $t_1$ and $t_2$ are times selected in accordance to rules well known to those skilled in the pertinent art. When two signals have a relatively low correlation or are uncorrelated, the above integral becomes relatively small.

In particular, received signal correlation is a phenomenon whereby the variations in the parameters (i.e., amplitude and phase) of a first signal of a first antenna track the variations in the parameters of a second signal of a second antenna in the vicinity of the first antenna; *Microwave Mobile Communications*, W. J. Jakes (ed.), chapter 1, IEEE Press, New York (1974). Also, the correlation between received signals can be determined by the correlation of the radiation patterns of the antennas receiving the signals. As is known to those skilled in the art, the radiation pattern of a particular antenna is the relative amplitude, direction and phase of the electromagnetic field in the far field region radiated at each direction. The radiation patterns are reciprocal in that they show the relative amplitude, phase and direction of a field transmitted from an antenna as well as the sensitivity of that antenna to incoming radiation from the same direction. The radiation pattern can be measured experimentally in an anechoic chamber, or calculated numerically with the use of a programmed computer.

Typically, the radiation pattern originates from a port of an antenna. A port is a part of the antenna at which a signal is applied to produce electromagnetic radiation or a point on the antenna from which a signal is obtained as the result of electromagnetic radiation impinging on the antenna. In general, an antenna may have more than one port. Cables which are typically used to connect the ports to a signal processing device are not considered part of the antenna. The radiation pattern of a port of an antenna is the antenna radiation pattern resulting after exciting only that particular port. The radiation pattern of a port of an antenna generally depends on many factors. The factors affecting the radiation pattern of a port of an antenna include the placement of the port, the materials from which the port and antenna are constructed, the structure and shape of the antenna, the relative position of the antenna in an antenna array, the relative position of the antenna within a communications device, as well as the position of other objects proximately spaced to the antenna. The reason for the radiation pattern's dependence on the aforementioned factors is electromagnetic coupling of the antenna to nearby objects. In general, electromagnetic coupling of an antenna to other objects or other antennas can modify the radiation pattern of one or more of the ports of the antenna.

The radiation pattern at a particular frequency of an antenna port in a particular array has several well-known characteristics. One such characteristic is a node or a null. A node or a null is a direction in space where the transmitted (or received) radiation power is zero or relatively small, e.g., more than 20 dB below the average radiated power. Another property is a lobe, which is a direction in space where the radiated power has a 'local maximum'. A direction in space where the radiated power is at its highest measured value (commonly referred to as 'absolute maximum') is called the main lobe of the port. A lobe generally has a width, corresponding to the directions around it that have appreciable radiated power. The width of the lobe is defined as the set of directions in the immediate neighborhood of the local maximum which has a radiated power of more than half the value of the local maximum. Also, two lobes from two different radiation patterns at the same frequency are considered as not overlapping if their respective widths do not overlap.

It is useful to describe the radiation pattern in terms of the radiation pattern of an ideal dipole antenna since many antennas have patterns that are similar to those of dipole antennas. A dipole radiation pattern is defined to have a null in two opposite collinear directions and a peak radiated power in the plane perpendicular to the collinear direction, with the power in that plane fluctuating by no more than 5 dB. Such a radiation pattern is said to be polarized along the axis of the nulls. When two ports of a given antenna have dipole radiation patterns that have null axes with relative angles higher than 20 degrees, the antenna is dually polarized at a given frequency when only these 2 ports are operating at that frequency. If the dually polarized antenna has axes with relative angles between 70 and 110 degrees, it is said to be cross-polarized. Similarly, if m ports of an antenna, with m equal to 3 or greater, have dipole radiation patterns, such that any two axes have a relative angle greater than 20 degrees, then the antenna is m-fold polarized at a given frequency when all m ports are operating at that frequency.

The correlation function of two radiation patterns is a useful measure of the degree of their overlap. It is defined as the magnitude of $$\frac{\int dk \overrightarrow{E_1}(k) \cdot \overrightarrow{E_2}(k)^*}{\sqrt{\int dk \left|\overrightarrow{E_1}(k)\right|^2 \int dk \left|\overrightarrow{E_2}(k)\right|^2}}$$

$E_1(k)$ and $E_2(k)$ are the far field vector electric fields at direction k of the radiated field at a given frequency due to ports 1 and 2 respectively and $E_2(k)^*$ is the complex conjugate of the far field vector electric field at direction k due to port 2. The correlation between radiation patterns can be calculated based on the experimentally determined or numerically calculated individual radiation patterns.

When two antennas are placed sufficiently far from each other, the correlation of their radiation patterns at the same frequency will be very small. A result of this effect is that the received signal from two antennas spaced sufficiently apart in a rich scattering environment will be uncorrelated. Typically, it is recommended that to avoid strong correlation the distance between the antennas should be at least $$\frac{\lambda}{2},$$

where $\lambda$ is equal to c/f which is the wavelength corresponding to the largest frequency f within a band of frequencies being used for communication by the antennas, and c is a well-known physical constant representing the speed of light in vacuum; *Microwave Mobile Communications*, W. J. Jakes (ed.), chapter 1, IEEE Press, New York (1974). Low correlation among the radiation patterns of the different antennas in the array is an essential condition to ensure the good performance of the array when used for a MIMO system. However, many wireless devices, particularly portable wireless devices, provide relatively little space for an antenna array.

One approach that has been proposed for packaging many antennas into a small space is to construct an array of individual antennas; Vaughan et al., U.S. Pat. No. 5,771,022; "Closely Spaced Monopoles for Mobile Communications", Rodney G. Vaughan and Neil L. Scott, *Radio Science* vol. 28, Number 6, PP 1259–1266 (1993). In this antenna array approach, several individual antennas with various desirable engineering properties (e.g., high gain, lightweight, small, easily manufacturable), are assembled into an antenna array. It is found that under certain circumstances individual antennas can be spaced a small fraction of $\lambda$ (less than $0.2\lambda$, for example) and even with the electromagnetic coupling between the antennas, the correlation between signals received at the two antennas can remain smaller than 0.7. Further, the array is to be coupled to a combining stage to process a single communication channel. In addition this approach uses the antenna only for receiving signals; it does not address the issue of simultaneous transmission and reception of multiple distinct signals as required by MIMO applications. Further, this approach does not address the specific space constraints imposed on the size of the array by portable wireless devices such as cell phones and PDAs. The antennas in the array are dipole wire antennas which usually operate well for an antenna length of $\lambda/2$ and therefore cannot meet the space constraints of many portable devices.

Thus, in order for many portable wireless devices performing MIMO operations to achieve relatively high information transfer rate, they need to use an antenna array that allows the simultaneous transmission and reception of uncorrelated signals. Such an array can be produced by separating the antennas in the array by at least half a wavelength. However, an antenna separation of at least half a wavelength would result in arrays too large and cumbersome for relatively small devices (e.g., PDA's, cell phones). What is therefore needed is a MIMO system comprising a multiple signal processing device coupled to a compact antenna array capable of transmitting and/or receiving uncorrelated signals.

SUMMARY OF THE INVENTION

The present invention is a wireless communication device and a method for configuring an antenna cluster used in such a device. The wireless communication device of the present invention comprises a cluster of multiple port antennas coupled to at least one signal processing device where the cluster occupies a relatively small volume of space and the wireless communication device is able to simultaneously transmit and/or receive multiple uncorrelated communication signals.

In the antenna cluster each antenna port operates within a frequency band having maximum frequency f. The antennas within the cluster are arranged such that at least one pair of antenna ports is placed within a volume whose longest linear dimension is $\lambda/3$ or less where $\lambda$ is equal to c/f. The cluster comprises N antennas where N is an integer equal to 2 or greater. Each operating antenna port has a radiation pattern representing the relative amplitude levels and phase values of the electromagnetic waves being received and or transmitted by the antenna port along different directions. The coupling between antenna ports causes their respective radiation patterns to be modified. In a preferred embodiment, each of the antennas in the cluster contains dielectric material; such antennas are commonly referred to as dielectric antennas. The dielectric materials promote the modification of the radiation patterns, as well as allowing for the construction of smaller antennas without reducing their efficiency.

The positioning and orientation of the antennas and thus the construction of the antenna cluster is done in accordance with the method of the present invention. The positioning of the antennas with respect to each other and with respect to the signal processing device is such that their corresponding radiation patterns have main lobes that face different directions and radiation patterns with correlation of less than 0.7 between them. The positioning and orientation of the antennas in the cluster is an iterative process whereby the resulting correlation between radiation patterns is measured and the direction of the main lobe of the pattern is determined. The antennas are thus positioned to achieve relatively high information transfer rates.

DETAILED DESCRIPTION

Figure 1A:
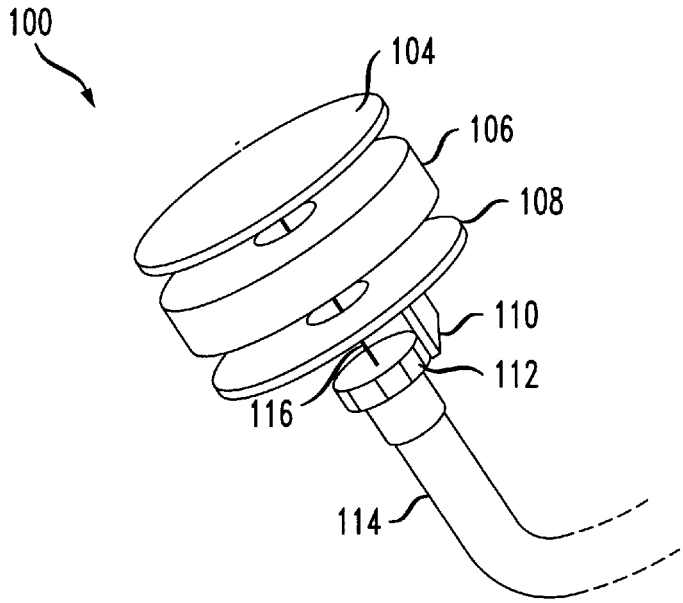
FIG. 1A is an exploded perspective view of a dielectric antenna.

The present invention is a wireless communication device and a method for configuring an antenna cluster used in such a device. The wireless communication device of the present invention comprises a cluster of multiple port antennas coupled to at least one signal processing device where the antenna cluster occupies a relatively small volume of space and the wireless communication device is able to simultaneously transmit and/or receive multiple uncorrelated communication signals (i.e., signals with relatively low correlation (e.g., 0.7 or less) between them) between any two ports of any two antennas in the cluster or between any two radiation patterns from any two ports of an antenna or different antennas in the cluster. Therefore, the communication device of the present invention can perform MIMO operations.

In the antenna cluster each antenna operates within a frequency band having maximum frequency, f. The antennas within the cluster are arranged such that at least one pair of antenna port is placed within a volume of space (e.g., within the communication device) whose longest linear dimension is $\lambda/3$ or less where $\lambda$ is equal to c/f. The cluster comprises N antennas where N is an integer equal to 2 or greater. Each operating antenna port has a radiation pattern representing the relative amplitude levels and phase values of the electromagnetic waves being received and or transmitted by the antenna along different directions. The coupling between antenna ports causes their respective radiation patterns to be modified. In a preferred embodiment, at least one of the antennas in the cluster contains dielectric material; such antennas are commonly referred to as dielectric antennas. The dielectric material promotes the modification of the radiation patterns and allows for the construction of smaller efficient antennas.

The positioning of the antennas and thus the construction of the antenna cluster is done in accordance with the method of the present invention. The positioning of the antennas with respect to each other and with respect to the signal processing device is such that during the operation of the antennas, they have corresponding radiation patterns whose main lobes face different directions and such radiation patterns have a correlation of 0.7 or less between them. The positioning and orientation of the antennas in the cluster is an iterative process whereby the radiation pattern is measured and the resulting correlation between radiation patterns of all the ports is measured. The antennas are thus positioned and oriented to achieve relatively high information transfer rates.

The signal processing device comprises well known transmission, reception and processing circuitry typically used in wireless communication devices such as cell phones, PDAs and wireless PCs. Further, at least one antenna in the cluster is at least partially constructed from dielectric material having a dielectric constant equal to 2 or greater (i.e., $\in \geqq 2$) in the frequency range at which the antenna cluster is operating. An antenna is operating at a frequency, f, when electromagnetic radiation having frequency f is transmitted and/or received by at least one port of the antenna.

It should be noted that not all, of the antennas in the antenna cluster need to have multiple ports. Thus, the wireless communication device of the present invention can also be configured such that at least some or all of the antennas in the cluster are single port antennas. Further, another embodiment of the apparatus of the present invention is a communication system whereby a signal processing device is coupled to the antenna cluster for simultaneous transmission and/or reception of communication signals. The communication system can be, for example, part of communication equipment located at a base station of a wireless communication network or it can be part of a wireless devices such as cell phones, PDAs and wireless PCs.

The antenna cluster is formed with antennas arranged in a linear, planar or three-dimensional fashion in the sense that the centers of gravity of each antenna in the cluster lies approximately on a straight line, approximately in a plane or a three dimensional space. It will be readily understood that the antennas forming the cluster are mounted on conventional support mechanisms (not shown). Further, not all of the ports of the antennas in the cluster have to be operating; the present invention is not limited to a cluster of antennas in which all of the ports of the antenna cluster are operating at the same frequency. At any instant in time, some or all of the antennas may not be operating. The signals applied to the ports of the cluster that are operating can be correlated, uncorrelated or partially correlated.

The positioning of the antennas with respect to each other and the positioning of the antenna cluster with respect to the signal processing device is such that the correlation between any two antenna ports in the cluster is relatively low (i.e., 0.7 or less) and the information transfer rate is relatively high.

In particular, the antennas are positioned and oriented with respect to each other such that the coupling between antennas modifies their radiation patterns resulting in the correlation between any two radiation patterns being less than or equal to 0.7, allowing any two of the ports of the cluster to operate relatively independently of each other. As a result, the antennas of the cluster can be placed relatively close to each other without their respective radiation patterns being significantly correlated to each other. Therefore, the number of antenna ports clustered in a given space—that is, the density of antennas in the antenna cluster—can be increased without incurring significant correlation. As a result, more independent signals can be transmitted and/or received through these antennas at the given frequency in a multipath environment in a given space.

As previously stated, the antennas in the cluster are positioned and oriented not only for achieving relatively low correlation between their radiation patterns but also to achieve relatively high information transfer rates in a multipath scattering environment. It is well known to those skilled in the art that the information transfer rate of an antenna depends on the transmission matrix H between a transmit antenna array and a receive antenna array. For a system with $N_T$ transmitting ports labeled j=1 . . . $N_T$ transmitting signals $T_j$ and $N_R$ receiving ports labeled i=1 . . . $N_R$ receiving signals $R_i$, H is a matrix of $N_R \times N_T$ complex coefficients such that $$R_i = \sum_{j=1}^{N_T} H_{ij} T_j + \eta_i$$

where $\eta_i$ is the noise at receiver i, which we will here assume to be gaussian and independently distributed with power n.

It should be noted that the above definition of H is a narrow band definition. A wideband definition, which is known to those skilled in the art can also be used. It should be noted that the coefficient matrix is not stationary; that is, its coefficients will fluctuate in time due to moving objects or scattering that affect the multipath properties. The coefficients of the transmission matrix H will also vary in time if either one of the antennas arrays is in motion. For a given transmission transmission matrix H between two antenna arrays, the maximum achievable error free information transfer rate (or capacity, C) for independently transmitting ports is calculated by using the following formula:

$$C = \log_2\left\{ det\left[ I_{N_R} + \frac{HH^+}{nN_T} \right] \right\}$$

where $I_{N_R}$ is an identity matrix of dimension $N_R$. $H^+$ is the transpose complex conjugate of the transmission matrix H. The wireless communication device of the present invention allows the measurement of the transmission matrix element by element for various antenna ports in the cluster. Once the transmission matrix is obtained, the information transfer rate can be calculated using the formula above. When the transmission matrix is measured in an environment having temporal and spatial variations, it is desirable to obtain a large ensemble of measurements of H. From each transmission matrix H in the ensemble, one value of information transfer rate C is calculated, and as a result of the multitude of transmission matrices, a statistical distribution of information transfer rate values is obtained.

Figure 1B:
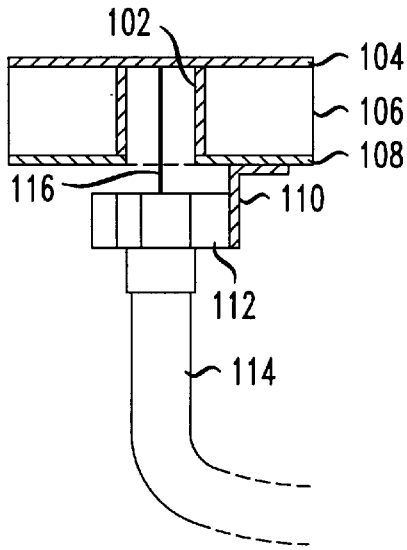
FIG. 1B is a side view of the dielectric antenna of FIG. 1A.

Referring now to FIGS. 1A and 1B there is shown an exploded perspective view and a side view respectively of antenna 100, which is used to construct an antenna cluster for the wireless device of the present invention. It is noted that the antenna cluster of the present invention is not limited to any particular type of antenna. For ease of explanation only, the embodiment of FIGS. 1A and 1B is a single port antenna, but in general antennas of the invention may be multiple port antennas. Antenna 100 comprises dielectric material 106 positioned between and making contact with metallic layers 104 and 108. Layers 104 and 108 are electrically coupled to each other via metallic surface 102. Antenna 100 is driven by voltage through coaxial cable 114, which is connected to the antenna by means of connector 112. The central male pin of connector 112 (not shown) is in mating contact with metallic female pin 116 of the antenna extending from metallic layer 104 through openings in dielectric material 106 and metallic layer 108. The outer part of connector 112, which is connected to the grounded outer conductor (not shown) of coaxial cable 114, is attached to metallic layer 108 via metallic flange 110. Antenna 100 is a particular version of a dielectric antenna element manufactured by the TOKO Corp. and is part of the DAC Series of antennas typically mounted on Personal Computer Memory Card International Association (PCMCIA) cards.

Figure 2A:
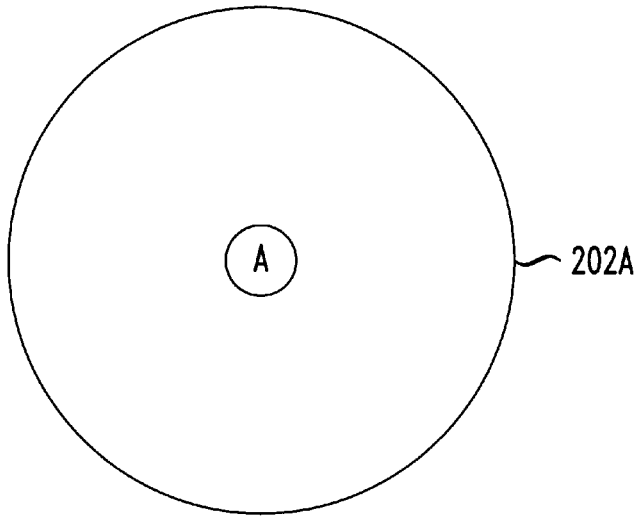
FIG. 2A is a top view of an operating antenna and a mapping of its isotropic radiation pattern.
Figure 2B:
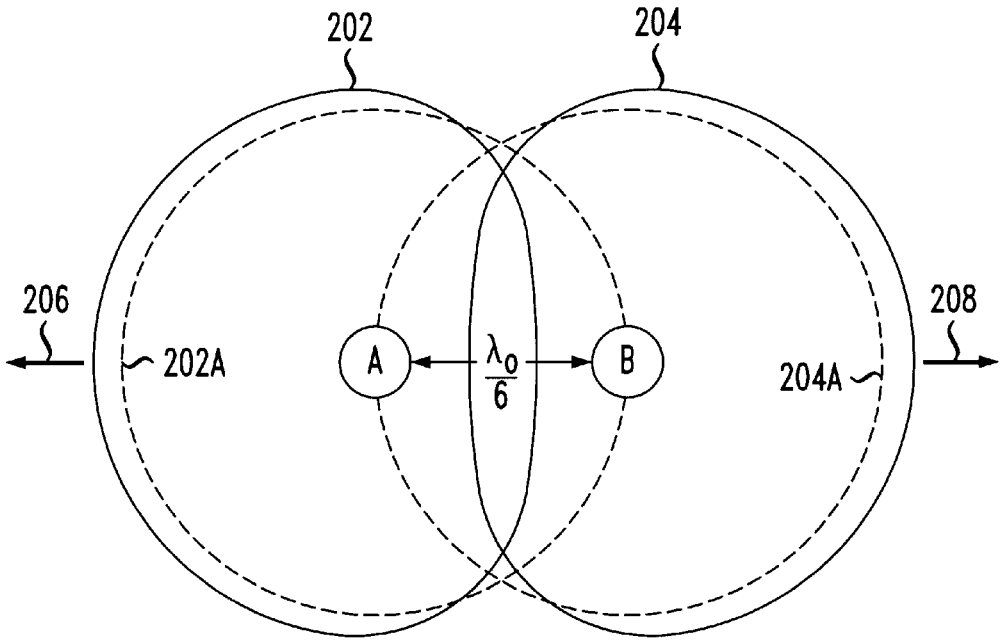
FIG. 2B is a linear cluster embodiment of the present invention and a mapping of the antenna's radiation patterns.

Referring now to FIG. 2A there is shown a top view of antenna A which is constructed similarly to antenna 100 of FIGS. 1A and 1B. Also shown in FIG. 2A is horizontal radiation pattern 202A resulting from antenna A operating at a frequency of $f_0$ where there are no objects in the vicinity of antenna A. In this case, radiation pattern 202A is isotropic meaning that the antenna transmits and receives electromagnetic radiation in the same fashion in any radial direction in a horizontal plane. In FIG. 2B, in accordance with the method and apparatus of the present invention, a second substantially identical antenna, antenna B, operating at the same frequency, $f_0$, is positioned at a distance of less than $$\frac{\lambda_0}{3}$$

from antenna A. The two antennas form a linear cluster of antennas wherein a distance of less than $$\frac{\lambda_0}{3}$$

between antennas exists. The respective radiation patterns of antennas A and B (i.e., patterns 202 and 204) are modified as shown due to electromagnetic coupling between the antennas. Note that the dashed lines (202A and 202B) in FIG. 2B represent the unmodified radiation patterns. The resulting radiation patterns 202 and 204 of antenna A and antenna B respectively are relatively highly anisotropic. In FIG. 2B antenna A has an anisotropic pattern 202 which causes antenna A to receive and/or transmit signals predominantly in the general direction shown by arrow 206. Similarly, antenna B has an anisotropic radiation pattern 204 that allows it to receive and/or transmit signals predominantly in the general direction shown by arrow 208. The two antennas thus transmit and receive signals in different (e.g., opposing) directions. This results in very low correlation between the antenna A and antenna B radiation patterns and, consequently, in independent respective signals in a multipath environment. If the radiation patterns remained isotropic (as shown by dashed lines 202A and 204A) even when antenna A and antenna B were positioned relatively close to each other the signals from the two antennas would be highly correlated. In the preferred embodiment of the antenna cluster of the present invention, the antennas contain dielectric material, which enhances electromagnetic coupling, thus promoting the modification of the radiation patterns.

The radiation pattern of antenna A in the absence of other objects in the vicinity of antenna A and the patterns of antenna A and antenna B, when close to each other, are mapped through well known mathematical modeling and/or measurement techniques. The correlation between signals from each of the anisotropic patterns is measured and or calculated also with the use of well known techniques. An iterative process of adjusting the relative positioning and orientation of the antennas and obtaining the respective radiation patterns and the resulting correlation is performed to determine the proper positioning that yields the least amount of correlation. In the particular linear cluster of FIG. 2B, the distance between the antennas is $$\frac{\lambda_0}{6}.$$

It should be noted that even though both antennas are operating at the same frequency, the apparatus of the present invention comprises antennas in the cluster operating within a range of frequencies including their respective resonant frequencies and as such the antennas in the cluster need not all operate at the same frequency.

It should be noted that because of the interaction between radiation patterns of antennas in a cluster arrangement, the amount of power received by these antennas could be somewhat reduced. A reduction in power causes a corresponding reduction in the antenna's information transfer rate. However, the corresponding reduction in the antenna's information transfer rate is not linearly proportional to the power reduction. Even so, possible reduction of total transmit or received power should be considered together with the amount of correlation when configuring the cluster in accordance with the apparatus and method of the present invention. In the case of antenna A and antenna B shown in FIG. 2B, an acceptable configuration is found such that there is relatively low correlation between signals of the antennas and virtually no power reduction. Despite the changes in their radiation patterns, the total power that could be transmitted or received by each of the antennas remains the same, since the "squeezing" of each of the patterns from the side of the other antenna is compensated by an expansion in the opposite direction.

Figure 3:
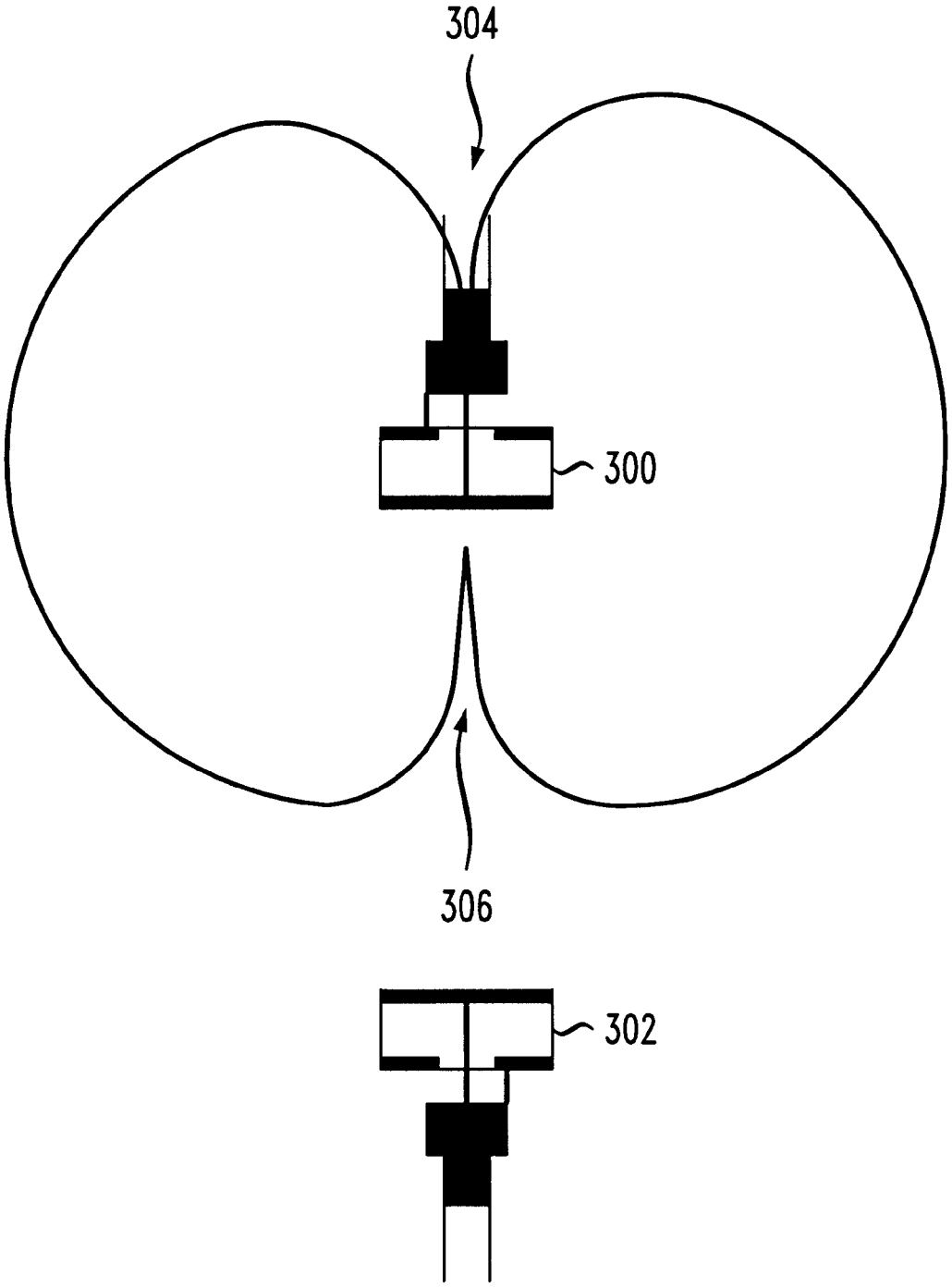
FIG. 3 is close-up view of two antennas of a cluster of antennas with the radiation pattern of one antenna having nulls.

Referring now to FIG. 3 there is shown a vertical antenna pair 300 and 302. Antenna 300 has a vertical radiation pattern having nulls 304 and 306. Antenna 302 is advantageously placed within null 306. The placement of antennas of the cluster within nulls avoids the effects of a phenomenon known as shadowing. In shadowing, one antenna becomes an obstacle blocking some of the signals being received by another nearby antenna. In many cases, mutual shadowing occurs where two or more antennas become obstacles to each other. By placing the antennas in nulls whenever possible, the antennas can be oriented so that their radiation patterns are not blocked or disturbed by the presence of other antennas.

Figure 4:
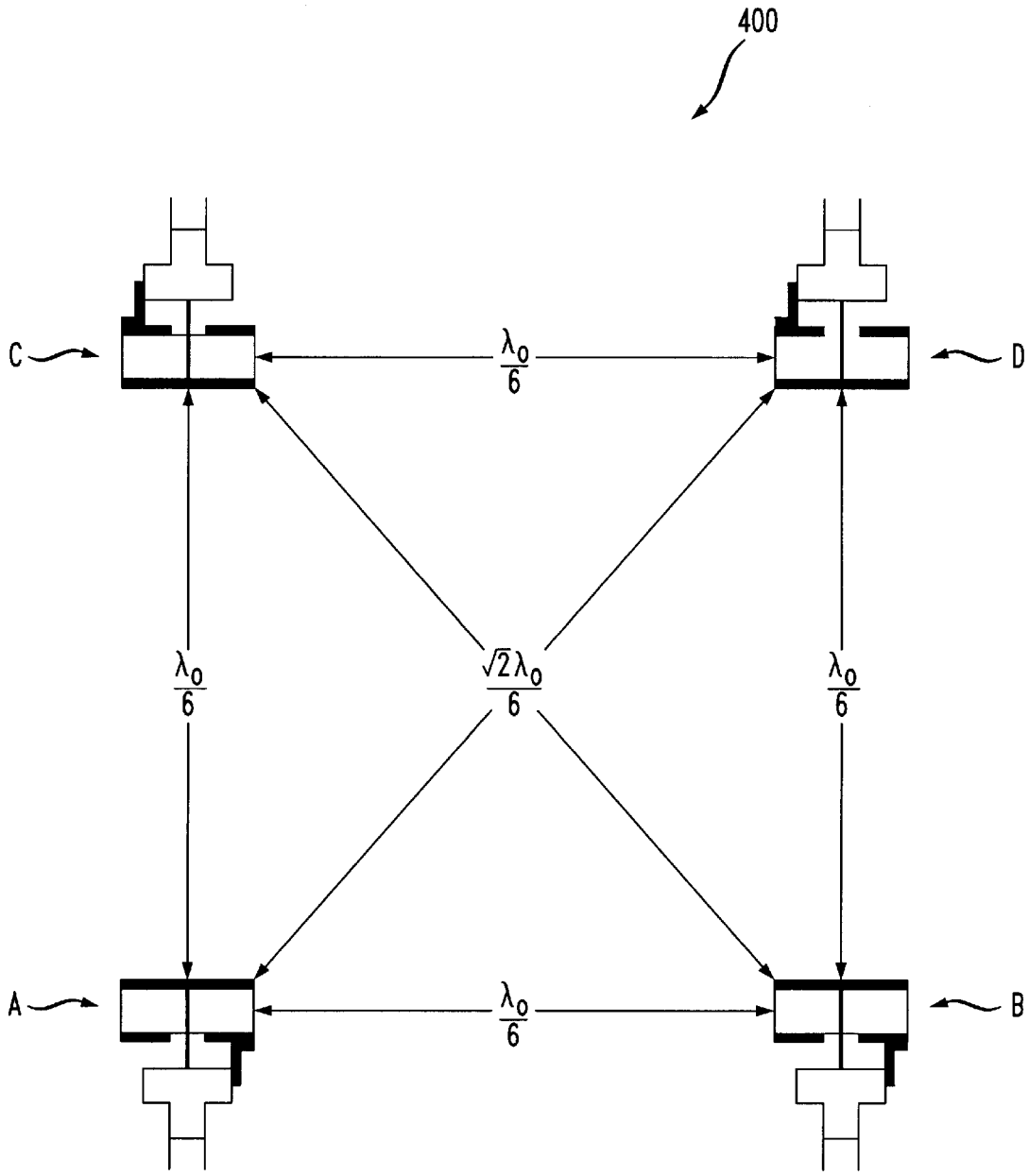
FIG. 4 is a square planar antenna cluster used in the wireless communication device of the present invention.

Referring now to FIG. 4, a cluster (400) of 4 antennas is shown whereby the antennas are aligned to form a square vertical planar cluster. Each of the 4 antennas has a resonant frequency of $f_0$. The distance between antennas along the sides of the square plane is $$\frac{\lambda_0}{6}.$$

Note that the diagonal distance between antennas (i.e., distance between antennas A & D and antennas B & C) is $$\frac{\sqrt{2}\lambda_0}{6}.$$

Therefore, for the square planar antenna shown in FIG. 4, the distance between any two antennas is less than $$\frac{\lambda_0}{2}.$$

Antennas C and D are positioned with respect to each other using the same procedure described above for the cluster shown in FIG. 2. Antennas C and D are then brought near antennas A and B causing the radiation patterns of the antennas to interact with each other. An iterative process follows where the antenna positions and orientations are adjusted and the resulting correlation of each antenna is measured to allow each antenna to operate independently of the remaining antennas. In particular, as with the two antenna cluster of FIG. 2B, the radiation pattern of each antenna is mapped and the correlation for each pattern is measured and the positioning and orientation of each antenna is adjusted to yield an antenna pattern that is uncorrelated or has relatively little correlation so as to allow independent operation of the corresponding antenna. The cluster configuration shown in FIG. 4 is found to preserve the average power transmitted or receive by each antenna by positioning an antenna in a vertical pair (A&C or B&D) of antennas in the null of the vertical radiation pattern of the second antenna; this technique was discussed with respect to FIG. 3.

Figure 5:
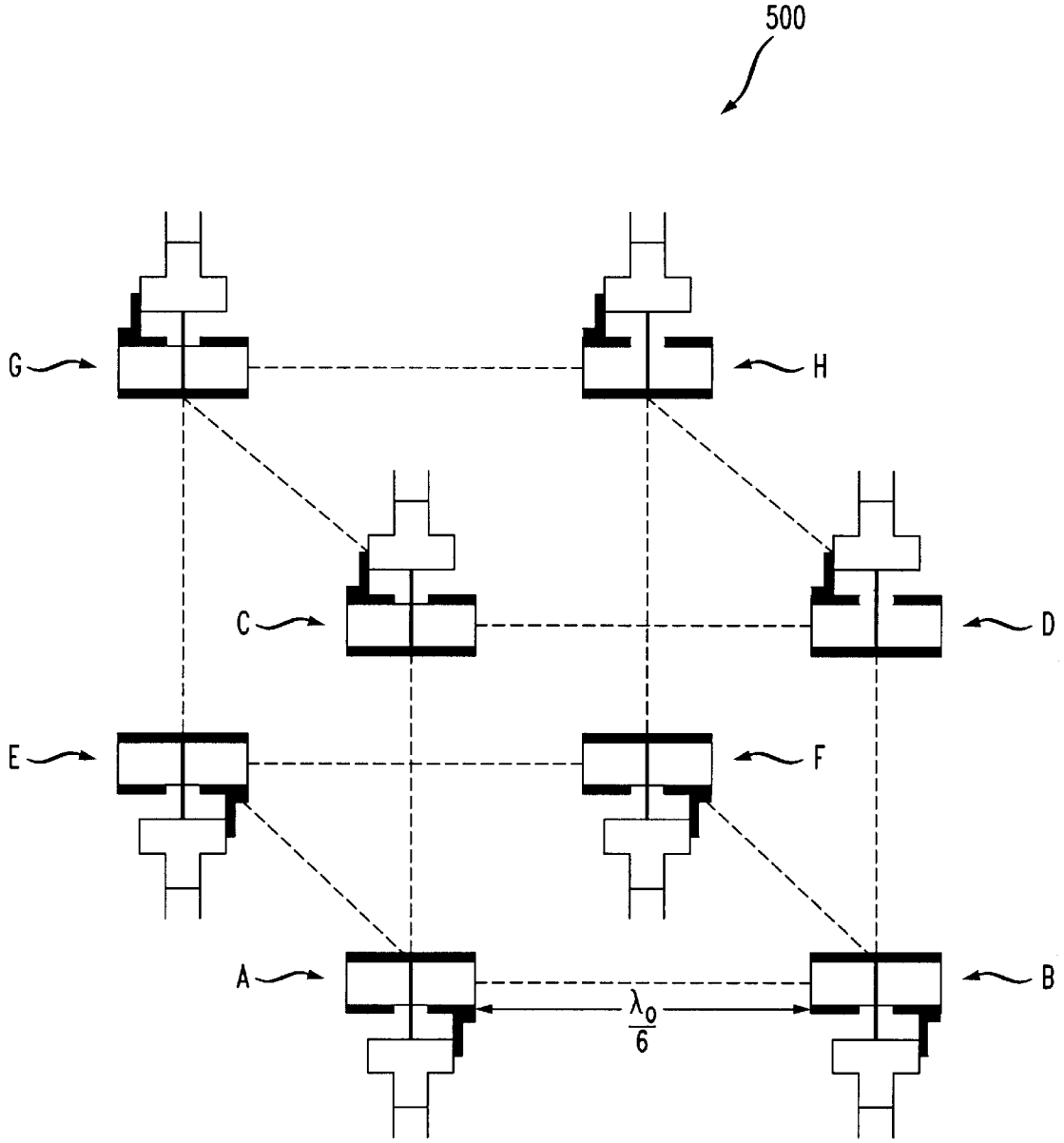
FIG. 5 is a cubic antenna cluster used in the wireless communication device of the present invention.

Referring now to FIG. 5, a cluster (500) of 8 antennas is shown where the antennas are aligned to form a cube as a possible configuration for the cluster of antennas. Taking into account the same correlation and power considerations, a first square planar cluster of 4 antennas (i.e., antennas A, B, C and D) is formed as per the procedure outlined above with respect to FIG. 4. A second planar cluster of antennas is similarly formed with antennas E, F, G and H. The two planar clusters are then positioned relative to each other to form a cubic cluster. As with the linear cluster of FIG. 2 and the square planar cluster of FIG. 4, the relative positioning and orientation of the antennas are iteratively adjusted to allow each antenna to operate independently of each other.

It should be noted that the antennas shown in the different clusters depicted by FIGS. 2–5 are supported by conventional support mechanisms (not shown) on which the antennas are mounted. Each antenna can have its own support mechanism or one support mechanism can be used for some or all of the antennas of a cluster. The support mechanism can be part of the structure of the communication device of the present invention. In the examples discussed above, distances between antennas operating at a frequency of $f_0$ are shown to be $$\frac{\lambda_0}{6}.$$

It should be noted that this particular distance is used for illustrative purposes only and does not in any manner limit the distance between antennas to any particular set of distances or a particular fraction of $\lambda_0$. For example, the longest linear dimension of a volume of space within which two ports are located can be $0.3\lambda$ or $0.2\lambda$. Further, the cluster configuration is not limited to any particular geometric shape or arrangement. Examples of linear, square planar and cubic clusters were used for illustrative purposes only.

It should further be noted that the communication device of the present invention can be implemented with various characteristics of the antenna cluster. For example, the antenna cluster may be configured where at least two of the multiple port antennas are single port antennas and at least two antennas are not cross-polarized. Also, the cluster can be configured where at least one of the multiple port antennas is a two-port antenna that is dually polarized. Another configuration is where at least one of the multiple port antennas is a three port antenna that is triply polarized. Yet another configuration is an m port antenna that is m-fold polarized where m is an integer that is equal to either 2, 3, 4, 5 or 6. Still another configuration is where any L ports are used to transmit and/or receive (simultaneously or not) a linear combination of S uncorrelated signals where L is greater than or equal to S and both L and S are integers equal to 1 or greater.

Figure 6:
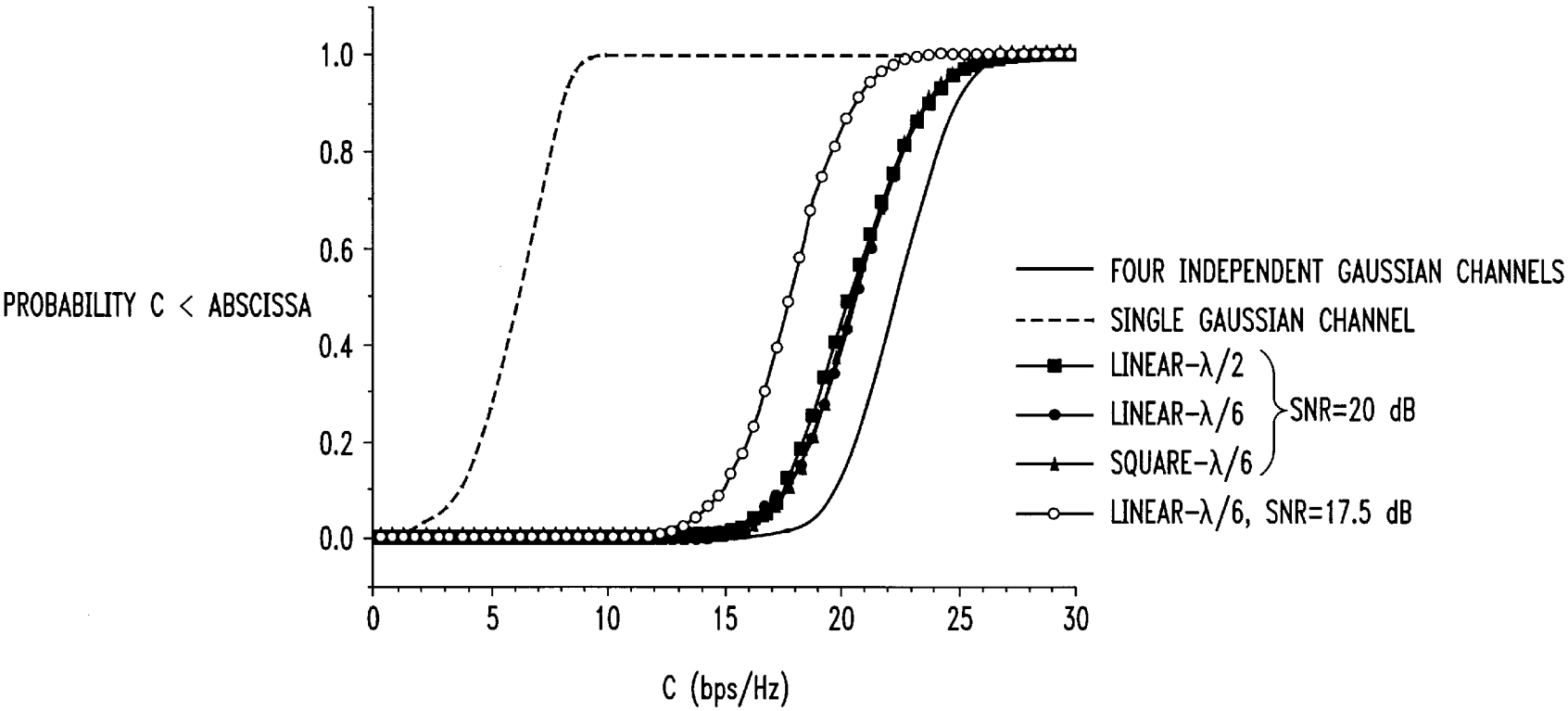
FIG. 6 shows the result of measurements of the information transfer rate for different antenna clusters from the present invention compared to the theoretical limits expected for Gaussian channels.

Referring now to FIG. 6, there is shown the results of measurement of the information transfer rate of a system with two identical 4-antenna transmit and receive clusters using various 4-antenna linear cluster configurations where such clusters were tested in a typical office building environment. The horizontal axis (or abscissa) of the graph have values of information transfer rate measured in bps/Hz (i.e., bits per second per Hertz). The vertical axis represents the probability that the information transfer rate of the antenna cluster is less than a particular value. As such, the various plots show the probability density functions (pdf) for different realizations of 4 antennas arranged as a linear cluster. The plots are compared to the theoretical limits for the information transfer rate of one gaussian channel (dashed curve) and the information transfer rate of four independent gaussian channels (solid curve). A gaussian channel is a theoretical channel having characteristics that follow Gaussian statistics. By having a cluster of four antennas each of which is operating independently in accordance with the method and apparatus of the present invention, the information transfer rate of the system is increased by almost a factor of four; that is the antenna array has a information transfer rate that is almost four-fold of the information transfer rate of a single theoretical antenna operating within a gaussian channel. The plots show that at equal signal to noise ratio (SNR) in both cases when the antennas are spaced close together ($\lambda/6$-separation, i.e., distance of less than $\lambda/2$) and for antennas with $\lambda/2$-separation the corresponding antenna clusters have virtually the same performance. In essence the $\lambda/6$-separation antennas remain uncorrelated to the same degree as the $\lambda/2$-separation antennas. In the case of the linear array for the $\lambda/6$-separation antennas, however, there is a 2.5 dB reduction in the average power per antenna due to shadowing. Although not shown, a linear array of four antennas is easily visualized whereby the average received power per antenna is reduced because the outer antennas block some of the signals being received by the two inner antennas of the linear array. This reduction in power (SNR=17.5) leads to lower information transfer rate values as shown by the open circles curve. The shadowing effect is overcome by rearranging the antennas into a square planar cluster as discussed above with respect to FIG. 4 where the antennas are placed in nulls of oppositely placed antennas as shown in FIG. 3. Such an arrangement avoids power reduction and thus no reduction of information transfer rate is observed.

Figure 7:
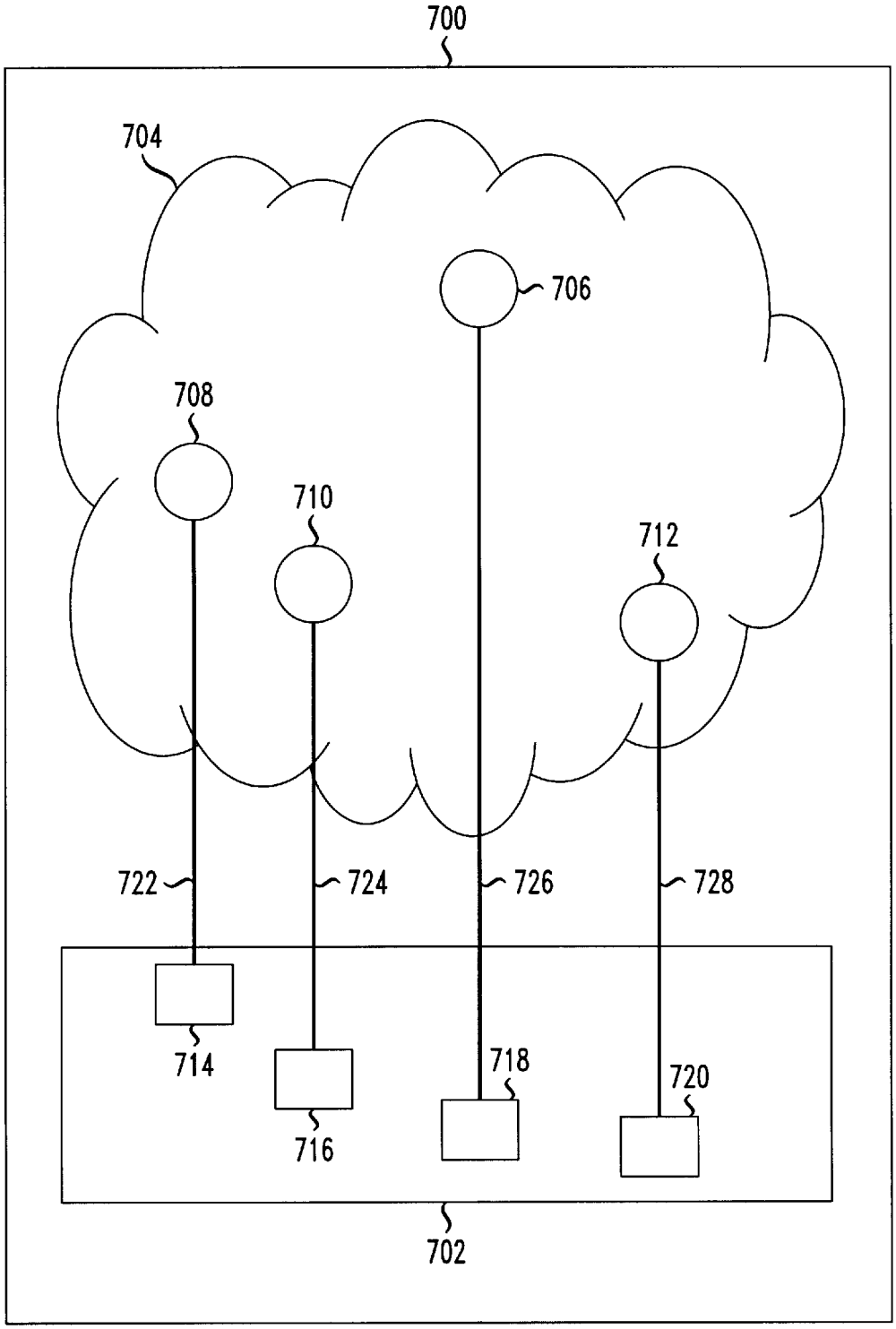
FIG. 7 shows an embodiment of the wireless communication device of the present invention.

FIG. 7 depicts a general schematic representation of a particular embodiment of the apparatus of the present invention. Wireless communication device 700 comprises an antenna cluster 704 coupled to signal processing device 702 via ports 706, 708, 710, 712 and input/output connections 714, 716, 718 and 720. It should be noted that more than one signal processing device can be coupled to the antenna cluster. Signal processing device 702 comprises at least one transceiver (not shown) coupled to the ports of the antenna cluster. A transceiver is a component of the device that can transmit and/or receive signals. Signal processing device 702 further comprises combining/processing circuitry which is also coupled to the antenna cluster. The antenna cluster of FIGS. 2–5 can be used for the communication device of FIG. 7. Signal processing device 702 can be configured such that it sends the same signal through various antenna ports where the signal comprises streams of bits with adjusted weights and relative phases so as to improve significantly the information transfer rate of the antenna cluster. Also, signal processing device 702 can send uncorrelated signals (e.g., different bit streams) through various antenna ports where such signals are scrambled with known spreading codes so as to significantly improve the cluster's information transfer rate. Signal processing device 702 can also simultaneously send uncorrelated signals through different antenna ports. The antenna cluster shown has four single port antennas with their respective ports being 706, 708, 710 and 712. The ports are coupled to the four input/output connections 714, 716, 718 and 720 of the signal processing device. It should be noted that the antenna cluster is shown in a generic form to emphasize that the antenna cluster is not limited to any particular size, shape or number of antennas. Also the corresponding couplings (i.e., 722, 724, 726 and 728) between the antenna cluster and the signal processing device may have any arbitrary length and/or shape, or may not be present at all (i.e., the antenna is connected to the signal processing device in a plug-in fashion). Depending of the intended use of the wireless communication device, signal processing device 702 can be used to implement a MIMO wireless device where at least two transceivers are coupled to the antenna cluster. The signal processing device can perform any type of coding of the information being transmitted and/or received including D-BLAST or V-BLAST. Even though the antenna cluster 704 is shown located inside of communication device 700, it should be noted that the antenna cluster can also be located outside of the communication device.

According to the method of the present invention, the radiation patterns associated with each of the antenna elements of the cluster of the present invention can be measured or calculated by techniques that are well known to those skilled in the art. An iterative procedure of constructing an antenna cluster comprises the step of positioning and orienting the antennas in the cluster such that during operation of the antenna cluster at a frequency, f, the resulting radiation patterns of each operating antenna port have a main lobe that points in a direction that is different from the direction pointed to by any other lobe and at least a pair of the antenna ports are placed in a volume of space whose longest linear distance is $\lambda/3$ or less where $\lambda$ is equal to c/f. The positioning and orienting of the antennas in the cluster is one of the factors that determines the resulting radiation pattern for each of the antenna ports and/or determines the transmission matrix H between two antenna clusters placed in a multipath environment. The iterative procedure allows for the modification of the overall structure of the antenna cluster such that an ensemble of transmission matrices H that indicate relatively high achievable information transfer rates or capacities is obtained. Each modification of the antenna cluster, i.e., positioning and orienting of antennas, is followed by measurements and/or calculations of the resulting radiation patterns of each antenna port and the calculation of the correlation between signals received or transmitted by the antenna. A programmed computer can be used to calculate the resulting radiation pattern. The antennas can be first positioned and then oriented or first oriented and then positioned. Orienting the antenna is defined as modifying the direction pointed to by any part of the antenna. One way of positioning and orienting the antennas is to direct the antennas such that the antenna ports have non-overlapping full width half maximum regions of their main lobes. Another way to position and orient the antennas is to place antennas in resulting radiation nulls of other antenna ports. The step of adjusting and orienting the antennas further comprises the step of obtaining a statistical distribution of achievable information transfer rate values by measuring a set of transmission matrices H as the position of scattering objects in a multipath environment changes or as the position of the antenna cluster is changed within the multipath environment. The modifications to the structure of the antenna cluster are performed until the desired performance characteristics of the antenna cluster is achieved or the desired performance of the antenna cluster coupled to a communication device is achieved. For example, the structure can be modified such that the radiation patterns from any two antenna ports have a correlation that is 0.7 or below.

We claim:

1. A wireless communication device comprising:

at least one signal processing device; and a cluster of N multiple port antennas, which is capable of simultaneous transmission and/or reception of signals with relatively low correlation between the signals, is coupled to the at least one signal processing device where at least one pair of the antenna ports operating at a frequency, f, are placed within a volume of space whose longest linear dimension is $\lambda/3$ or less where $\lambda$ is equal to c/f and N is an integer equal to 2 or greater.

2. The wireless communication device of claim 1 where at least one of the antennas in the cluster are constructed partially from dielectric material having a dielectric constant of 2 or greater at the operating frequency.

3. The wireless communication device of claim 1 where the at least one pair of antenna ports, during their operation, have radiation patterns whose main lobes point in different directions.

4. The wireless communication device of claim 1 where the at least one pair of antenna ports, during their operation, transmit and/or receive signals with correlation of 0.7 or less between such signals.

5. The wireless communication device of claim 1 where the antennas are arranged as a linear cluster.

6. The wireless communication device of claim 1 where the antennas are arranged as a planar cluster.

7. The wireless communication device of claim 1 where the antennas are arranged as a cubic cluster.

8. The wireless communication device of claim 1 where the antennas in the cluster are DAC II series dielectric antennas manufactured by TOKO Corp.

9. The wireless communication device of claim 1 where during operation of any two ports of the antenna cluster, the ports have radiation patterns whose correlation between them is 0.7 or less.

10. The wireless communication device of claim 1 where at least one of the multiple port antennas is a two-port antenna that is dually polarized.

11. The wireless communication device of claim 1 where at least one of the multiple port antennas is a three port antenna that is triply polarized.

12. The wireless communication device of claim 1 where at least one of the multiple port antennas is an m-port antenna that is m-fold polarized where m is an integer equal to either 2, 3, 4, 5 or 6.

13. The wireless communication device of claim 1 where the at least one pair of antenna ports is placed in a volume of space whose longest linear dimension is 0.3λ.

14. The wireless communication device of claim 1 where the at least one pair of antenna ports is placed in a volume of space whose longest linear dimension is 0.2λ.

15. The wireless communication device of claim 1 where any L ports are used to transmit and/or receive a linear combination of S uncorrelated signals where L is greater than or equal to S and both L and S are integers equal to 1 or greater.

16. The wireless communication device of claim 1 where any L ports are used to simultaneously transmit and receive a linear combination of S uncorrelated signals where L is greater than or equal to S and both L and S are integers equal to 1 or greater.

17. The wireless communication device of claim 1 where the signal processing device processes the signals according to a D-BLAST architecture.

18. The wireless communication device of claim 1 where the signal processing device processes the signals according to a V-BLAST architecture.

19. The wireless communication device of claim 1 where the signal processing device sends signals, each of which comprises streams of bits, through each antenna port but with adjusted weights and relative phases so as to significantly improve the information transfer rate and where the signals sent to the antennas ports are the same.

20. The wireless communication device of claim 1 where the signal processing device sends simultaneously uncorrelated signals, comprising steams of bits, through the different antenna ports where such ports are scrambled with known spreading codes so as to significantly improve the information transfer rate.

21. The wireless communication device of claim 1 where the signal processing device sends simultaneously uncorrelated signals, comprising streams of bits, through the different antenna ports.

22. The wireless communications system of claim 1 where at least two of the multiple port antennas are single port antennas and at least two antennas are not cross-polarized.

23. A method of constructing an antenna cluster comprising N multiple port antennas capable of simultaneously transmitting and/or receiving communication signals while maintaining a relatively low correlation between signals of antennas in the cluster where N is an integer equal to 2 or greater, the method comprising the step of:

positioning and orienting the antennas in the cluster such that during operation of the antenna cluster at a frequency f, resulting radiation patterns of each operating antenna port have a main lobe that points in a direction that is different from the direction pointed to by any other lobe and at least a pair of the antenna ports are placed in a volume of space whose longest linear dimension is λ/3 or less where λ is equal to c/f.

24. The method of claim 23 where the step of positioning and orienting the antennas in the cluster comprises:

adjusting the positioning and orientation of antennas in the cluster;

calculating the resulting radiation pattern of each of the operating antenna ports; and calculating correlations between the resulting radiation patterns.

25. The method of claim 24 where the step of calculating the resulting radiation pattern comprises the step of using a programmed computer to calculate the radiation pattern.

26. The method of claim 24 where the step of adjusting the positioning and orientation of the antennas comprises the step of directing the antennas such that the antenna ports have non-overlapping full width half maximum regions of their main lobes.

27. The method of claim 24 where the step of adjusting the positioning and orientation of the antennas comprises the step of directing the antennas such that the correlation between the radiation patterns of any two operating antenna ports is reduced to 0.7 or below.

28. The method of claim 24 where the step of adjusting the positioning and orientation of the antennas further comprises the step of placing one antenna in a resulting radiation null of another antenna port.

29. The method of claim 24 where the step of adjusting the positioning and orientation of the antennas further comprises the step of obtaining a statistical distribution of achievable information transfer rate values by measuring a set of transmission matrices H as the position of scattering objects in the multipath environment changes.

30. The method of claim 24 where the step of adjusting the positioning and orientation of the antennas further comprises the step of obtaining a statistical distribution of achievable information transfer rate values by measuring a set of transmission matrices H as the position of the antenna cluster is changed within the multipath environment.

* * * * *